US012722753B2

(12) United States Patent
Papadopoulos et al.

(10) Patent No.: US 12,722,753 B2
(45) Date of Patent: Sep. 1, 2026

(54) SHALLOW DRAFT FLOATS PROVIDING INTACT STABILITY

(71) Applicants: Jeremy J. Papadopoulos, Manchester (GB); Vincent Loccisano, Wellesley, MA (US)

(72) Inventors: Jeremy J. Papadopoulos, Manchester (GB); Vincent Loccisano, Wellesley, MA (US)

( * ) Notice: Subject to any disclaimer, the term of this patent is extended or adjusted under 35 U.S.C. 154(b) by 387 days.

(21) Appl. No.: 18/489,409

(22) Filed: Oct. 18, 2023

(65) Prior Publication Data

US 2024/0140565 A1 May 2, 2024

Related U.S. Application Data

(60) Provisional application No. 63/381,347, filed on Oct. 28, 2022.

(51) Int. Cl.
*B63B 35/44* (2006.01)
*B63B 1/10* (2006.01)

(52) U.S. Cl.
CPC ..... *B63B 35/44* (2013.01); *B63B 1/107* (2013.01); *B63B 2035/446* (2013.01)

(58) Field of Classification Search
CPC .... B63B 35/44; B63B 2035/446; B63B 1/107
See application file for complete search history.

(56) References Cited

U.S. PATENT DOCUMENTS 3,285,213 A * 11/1966 Whittle ..... B63B 39/00 114/265
4,481,900 A * 11/1984 Rutten ..... B63B 21/48 114/311
10,029,773 B1 * 7/2018 Todter ..... B63G 8/08
2007/0028822 A1 * 2/2007 Schmitz ..... B63B 1/10 114/61.1

FOREIGN PATENT DOCUMENTS

WO WO-2016120599 A1 * 8/2016 ..... B63B 1/107

* cited by examiner

*Primary Examiner* — Stephen P Avila
(74) *Attorney, Agent, or Firm* — Keeley DeAngelo LLP; W Scott Keeley

(57) ABSTRACT

A shallow-draft float is configured with above-float buoyancy or below-float water lifters dimensioned to control the righting arm of the turbine as tip angle increases to 15 and then 30 degrees. The embodiment is configured for use with a floating wind turbine that has a center of mass above the water surface and is supported by relatively small floats. In an example embodiment, a buoyant structure resides above the float and provides additional flotation when submerged. In another embodiment, the structure beneath the water surface contains water that provides ballast as the float moves above the water surface. In various embodiments, structural elements that provide ballast or flotation may be stowed until needed.

7 Claims, 6 Drawing Sheets

112

SHALLOW DRAFT FLOATS PROVIDING INTACT STABILITY

TECHNICAL FIELD

The present disclosure relates in general to floating wind turbines and more specifically to shallow-draft floats designed to provide intact stability of a floating structure.

BACKGROUND

A wind turbine is a rotating machine that converts kinetic energy from wind into mechanical energy that is converted to electricity. Utility-scale, horizontal-axis wind turbines have horizontal shafts that are commonly pointed into the wind by a shaft and generator assembly within a nacelle, at the top of a tower that is yawed relative to the tower in order to align the rotor with the wind. The nacelle commonly houses a direct drive generator or a transmission and generator combination.

Offshore turbines are large, heavily loaded structures that incorporate complex electro-mechanical systems. They require maintenance similar to that of a ship and incur fatigue, corrosion and mechanical and electrical wear.

The state of the art includes offshore wind turbines that rest on the ocean bottom and are neither designed nor intended to be moved. In waters shallower than 60 m, wind turbines used for offshore applications commonly include single-tower systems mounted to the sea bed. Small-part maintenance requires transferring crew from a boat to the turbine during calm seas, then having the technicians climb to a great height with equipment and supplies. Any large-part maintenance requires a crane ship to lift and lower large parts during calm seas only.

Wind turbines used for offshore applications commonly include single-tower systems mounted to the sea bed. Some float, using shallow submersible or semi-submersible platforms employing spars or spar buoys, tension legs, or a large-area barge-type construction. Offshore turbines are usually connected to a local power grid. Produced electrical energy is transferred and conditioned by grid structures.

Spars are ballasted, elongate structures that float at the water line, placing the center of gravity lower than the center of buoyancy. A spar is moored to the sea floor.

Tension-leg platforms are permanently moored by tethers or tendons grouped at each of the structure's corners. A group of tethers is referred to as a tension leg. The design provides relatively high axial stiffness such that virtually all vertical motion of the platform is eliminated.

A large-area barge or "buoyancy-stabilized platform" is a heavy floating structure, moored to the sea bed, supporting a vertical axis turbine. Jack-up barges, similar to oil and gas platforms, are used as a base for servicing other structures such as offshore wind turbines. The state of the art emphasizes platforms that are immobilized against wave disturbance by mass, mooring, ballast and the like.

Floating turbines are maintained by crane ships and visiting crews. A crane ship in shallow water can self-stabilize by extending support legs to the sea floor, but those in deep water must rely on great size to mitigate wave motion. While floating turbines might be disconnected and towed to shore for easier maintenance, this is rarely done because towing is extremely slow and because detaching and reconnecting the mooring and electricity-export connections require labor-intensive effort.

A floating turbine with shallow drafts is light enough to be towed, yet moves more in waves than turbines designed with deep draft that are not designed to be towed. In a turbine with shallow draft, the rotor shaft and bearing assembly must be relatively stronger than those in deep-draft designs. Increasing the motion-tolerance of the rotor is less complicated and less costly than curtailing rotor motion. For this reason a shallow-draft design is economically and technically desirable, providing the floats can meet mandatory floating-structure requirements.

Floating structures are governed by International Maritime Organization rules, one of which is called "Intact Stability requirement." In testing to meet this requirement, a structure is tipped (in computer simulation) to angles up to 30 degrees, and the tendency to return upright (the restoring moment) is calculated for each angle. Restoring moment divided by system weight is called moment arm or righting arm, and the curve of righting arm versus tip angle is subject to specific requirements. Two of these requirements are:

1. The greatest righting arm must appear at tip angles of 15 degrees or more. This means that it must be increasingly difficult to tip the structure until 15 degrees is reached. As the tip angle increases beyond 15 degrees it is permitted to get easier.
2. The righting arm must remain positive to tip angles of at least 30 degrees. This means that if a structure is tipped to 30 degrees, and then released, it will right itself.

When tipped, a structure supported by widely separated shallow-draft floats will have either the high-side float rising out of the water, or the low-side float sinking into the water. Therefore a structure with a center of mass above the float plane, and floats spaced more than their width or height, would be unable to satisfy the intact-stability requirement. When a tip angle is imposed, floats on one side may leave the water. The maximum value of the righting arm occurs as soon as floats leave the water. This is commonly at a tip angle significantly less than 15° and in some cases close to 5°. Alternatively, when the angle of tip is increased, the floats on one side may sink. In this case the righting arm decreases as the tip angle increases; therefore the maximum righting arm occurs as soon as the float submerges, commonly at a tip angles well below 15°; in some cases as little as 5°.

To ensure that the angle of maximum righting arm exceeds 15°, there must be continued interaction with the water of the rising or submerging float. Floats should be designed taller than is needed to carry their intended weight, with a compact (low-cost) design.

A float is referred to in this disclosure as a portion of a floating platform that is lighter than water and provides flotation. In some embodiments a float is a hollow structure or ballast container designed to be at least partially beneath the surface of water and partially above it.

The term "textile" is an umbrella term that includes various fiber-based materials, including fibers, yarns, filaments, threads, different fabric types and the like.

SUMMARY

The present disclosure relates to a shallow-draft float configured for use with a marine structure that is supported by relatively small, widely spaced floats and has its center of mass well above the water surface. In some embodiments the marine structure is a floating wind turbine. One skilled in the art understands that the term "marine structure" may refer to any offshore floating structure such as an oil and gas rig, moored vessels, or similar structures.

In an example embodiment, a float has a ballast container beneath the water surface that essentially increases the distance over which the ballast container's rising float interacts with the water when a tipping force is applied to the vessel. When a tipping force acts on the turbine structure, the floats' ballast container supplies a counterforce that keeps the turbine structure from tipping. When the ballast container emerges from the water, its relative weight increases, providing increased counterbalance as the tipping angle increases. In some embodiments the ballast container is stowed until needed.

In another embodiment an additional buoyant structure resides above the float, to add buoyancy when the float is submerged. In some embodiments the buoyant structure is a rigid form, and in other embodiments the structure is an inflatable form that may be deployed as needed or may be automatically triggered as the float is submerged.

DESCRIPTION

Figure 1:
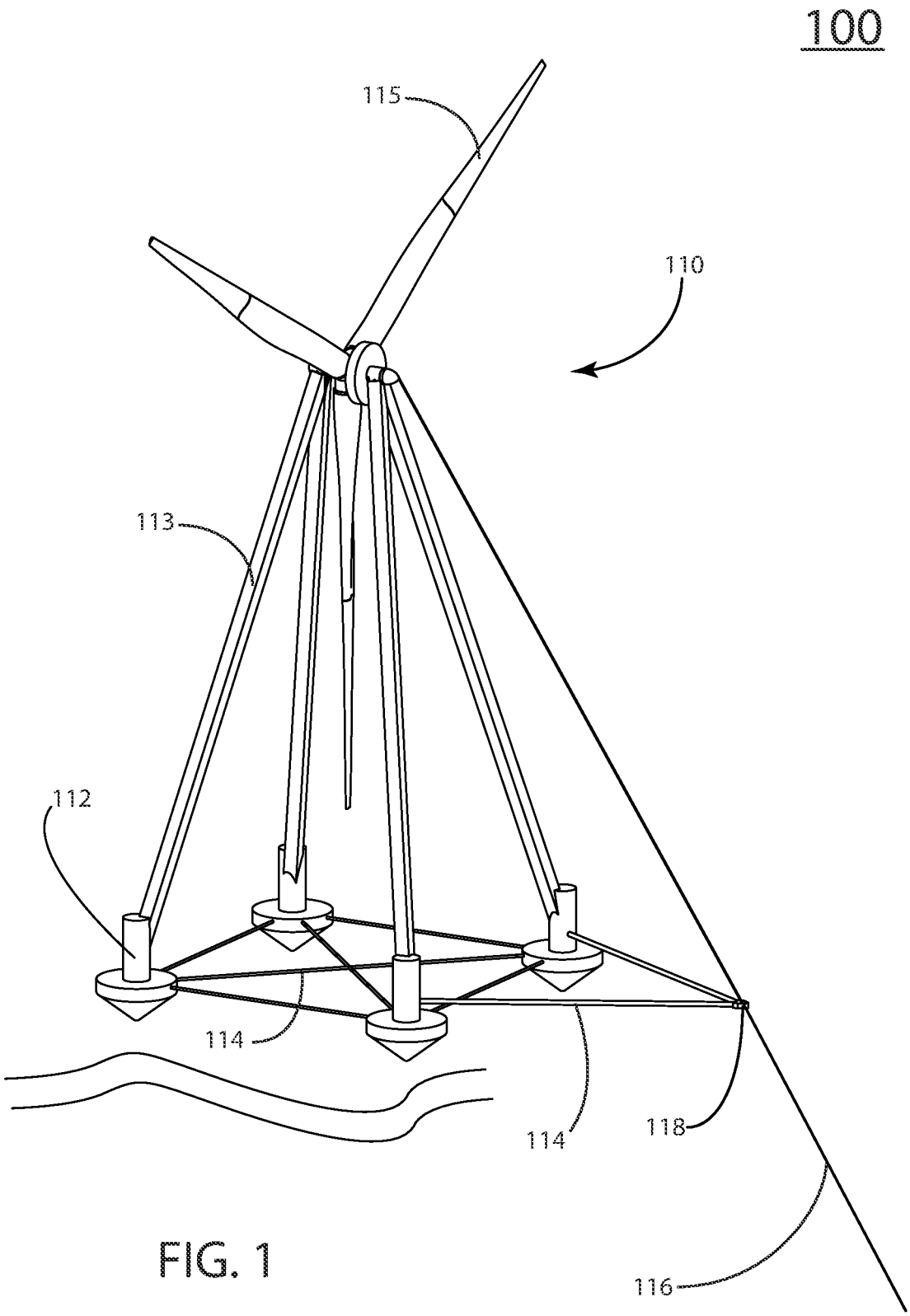
FIG. 1 is a perspective view of an example floating, moored turbine.

FIG. 1 shows a floating wind turbine 110 with extra buoyancy above the main floats. A rotor 115 is supported by structural elements 113 that are in turn supported by shallow-draft floats 112 that are further braced by a lower structure 114 that also supports a mooring point (or hitch point) 118. The hitch point 118 is joined to a mooring line 116.

Figure 2:
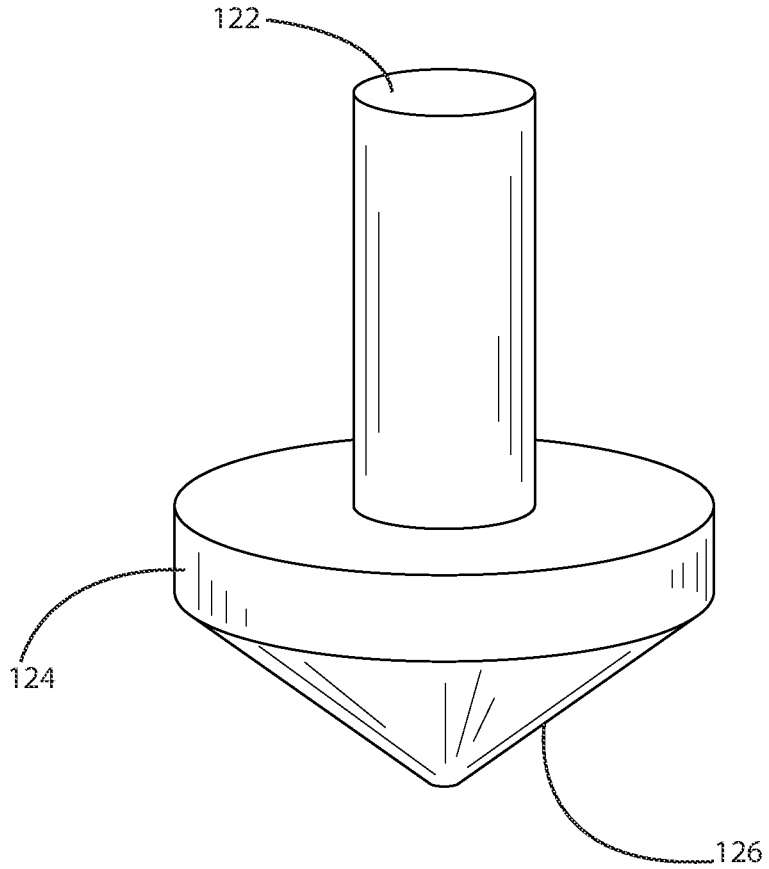
FIG. 2 is a perspective view of a float.

In an embodiment shown in FIG. 2, the shallow-draft floats 112 have a cylindrical portion 124, a conical lower section 126 and a tall, slender, upper buoyant structure 122. With a volume of this structure, a turbine tip tends to submerge some floats and fail to lift other floats from the water. In normal operation, a calm water surface tends to reach the cylindrical portion 124. When a sideways tipping force is applied to a turbine supported by four such floats in a quadrilateral arrangement, the conical lower section 126 and cylindrical portion 124 of two floats tend to submerge. The upper buoyant structure 122 provides additional flotation to increase the buoyancy required to change its orientation when the shallow-draft float 112 is submerged. In this way the righting arm keeps increasing after the large-diameter cylindrical portions 124 and the conical portions 126 are fully submerged. In some embodiments the upper buoyant structure 122 is a rigid form. In other embodiments the upper buoyant structure is an inflatable form that may be stowed in the cylindrical portion 124 until needed.

Figure 3:
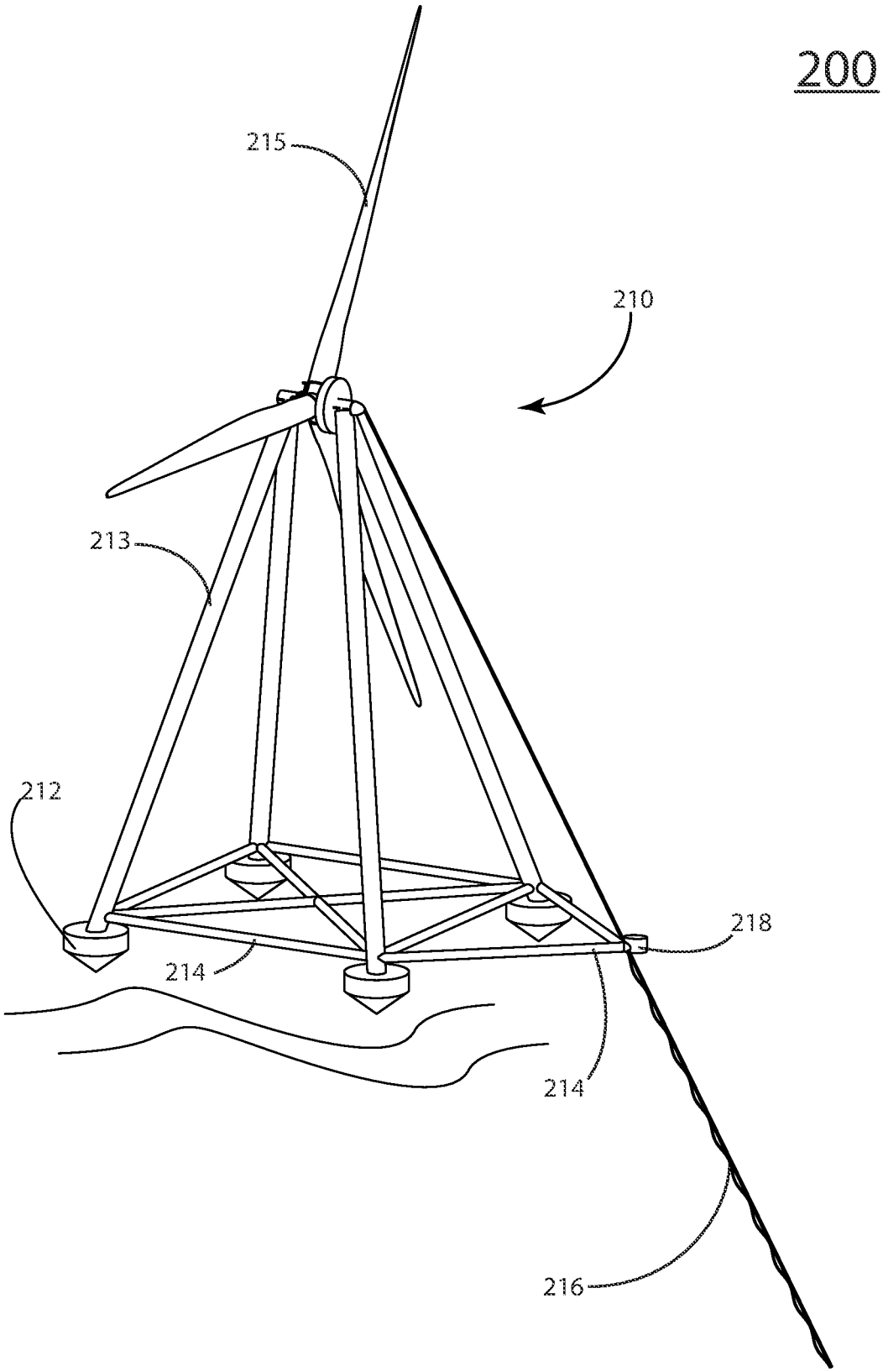
FIG. 3 is a perspective view of an example floating, moored turbine.
Figure 4:
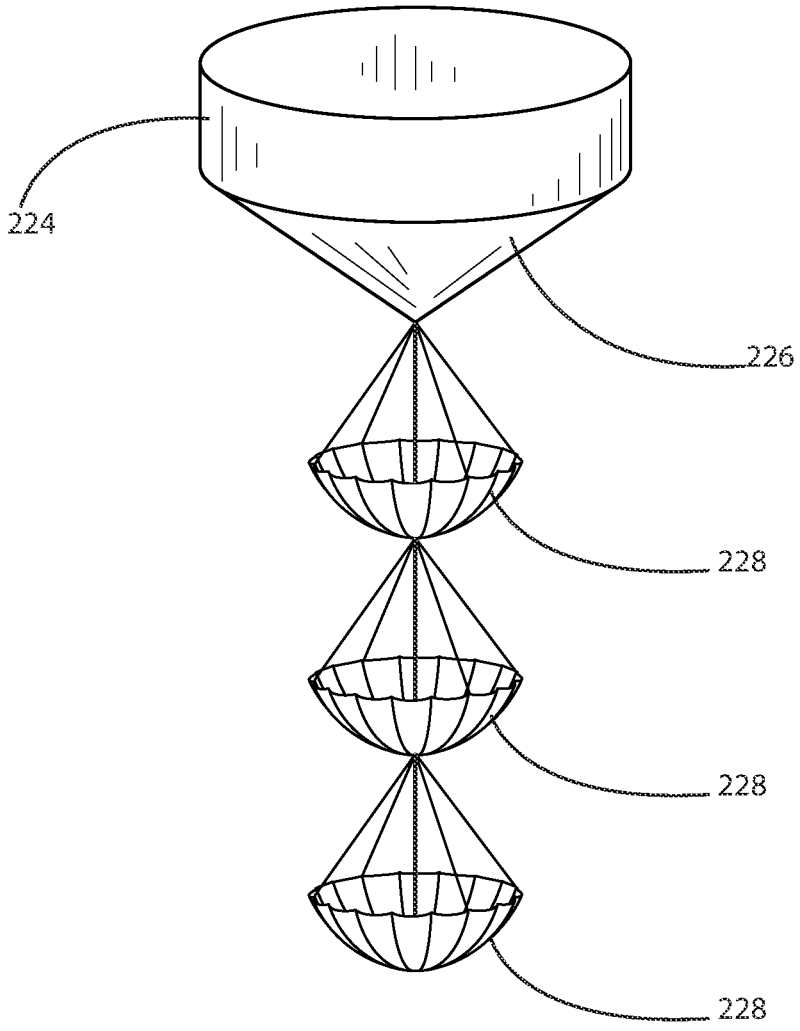
FIG. 4 is a perspective view of a float of the turbine in FIG. 3 with a series of textile forms deployed.

FIG. 3 shows an example embodiment 200 of a floating wind turbine 210. The shallow-draft floats 212 do not include the upper buoyant structure 122 of FIG. 1, and instead require below-float structures as shown in FIG. 4. The floating wind turbine 210 has a rotor 215 that is supported by vertical poles 213 which are in turn supported by shallow-draft floats 212 that are further supported by a cross ties 214 that join the shallow-draft floats 212 and the poles 213 across the water plane. The lower structure is joined with a hitch point 218, which is joined to a mooring line 216.

FIG. 4 shows an example embodiment of the shallow-draft float of FIG. 3. The float 212 has a cylindrical portion 224 and a conical lower portion 226. A series of textile forms 228 may be stowed in the float 212 and may be deployed when needed to counter a tipping force. One skilled in the art understands that an accessible area within the conical section 226 may be used to stow the textile forms 228. Textile forms 228 resemble inverted parachutes that can lift water above the surface when the float 212 begins to rise out of the water.

Figure 5:
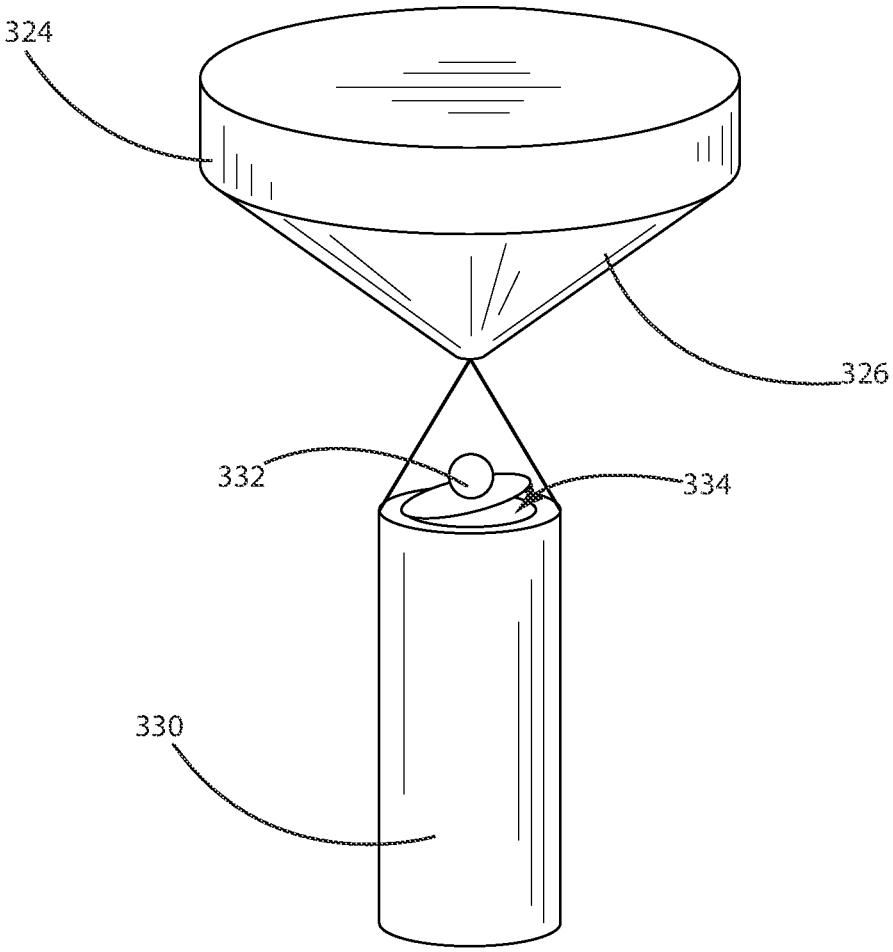
FIG. 5 is a perspective view of a float of the turbine in FIG. 3 with a container suspended beneath the water surface.

In FIG. 5 a float 312 is similar to floats illustrated in FIG. 3. The float 312 has a cylindrical portion 324 and a conical section 326 that is joined to a ballast container 330. The ballast container 330 has no bottom and a floating lid 332 that covers an opening 334. When in the water, the open container is full of water and will offer no resistance to small vertical motions. But when its top is lifted above the water surface, the floating lid 332 closes, retaining the water inside the container as it lifts, providing additional weight and downward force when float 312 is lifted out of the water. In another embodiment an actuator is affixed to the lid 332 and is in turn in communication with a controller. The controller may also be in communication with position sensors and may power the actuator to close the lid when the ballast container exits the water.

Figure 6:
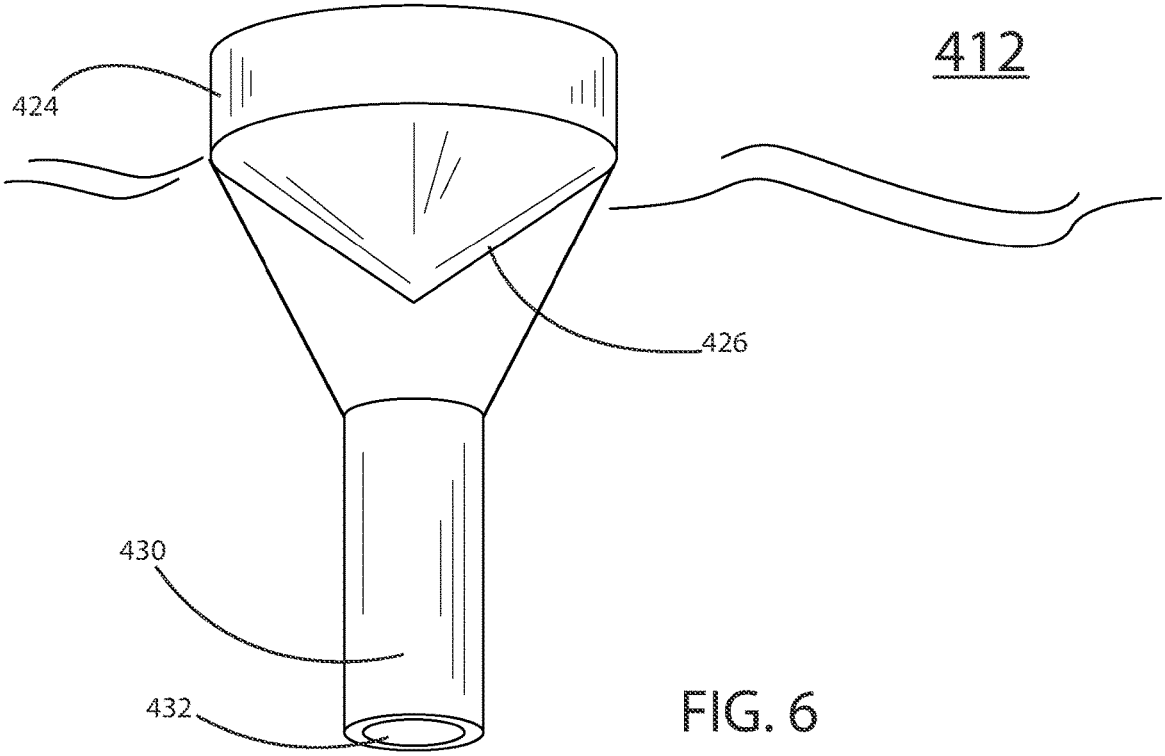
FIG. 6 is a perspective view of a float of the turbine in FIG. 3 with a container suspended beneath the water surface.

In FIG. 6, a float 412 is similar to floats illustrated in FIG. 3, having a cylindrical portion 424 and a conical lower portion 426. The float 412 is tethered to a ballast ballast container 430 having a remotely operated bottom 432 that can trap water when it is lifted above the surface.

Figure 7:
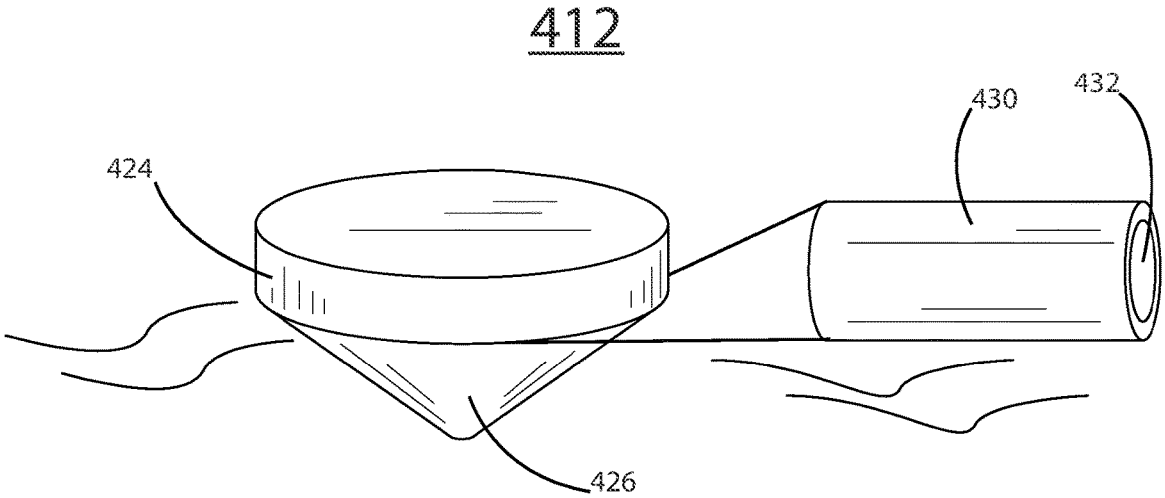
FIG. 7 is a perspective view of the apparatus of FIG. 6 with the container empty and floating on the water surface.

FIG. 7 One skilled in the art understands that a ballast container 430 of FIG. 6 may be later filled with air directly or remotely to return the ballast container 430 to the water surface when weather conditions offer no risk of tipping. When not in use the ballast container 430 is allowed to remain at or above the surface, while still connected to the float 412.

The invention claimed is:

1. A shallow draft float providing intact stability to a marine structure comprising:

a lower portion having an inverted conical section having a pointed bottom transitioning to a circular top which is engaged with a short cylindrical portion; and an upper portion being a tall cylindrical, inflatable textile form engaged at an end, atop said short cylindrical portion; and said float supports a marine structure; wherein said lower portion resides at least partially beneath a water surface and said upper portion resides above the water surface until a tipping force is applied to said marine structure forcing said lower portion beneath the water surface wherein said upper surface provides additional floatation to counter said tipping force and to provide intact stability.

2. The float of claim 1 wherein:

said marine structure is a wind turbine.

3. A float providing intact stability to a marine structure comprising:

said float having an inverted conical section having a pointed bottom transitioning to a circular top which is engaged with a relatively short cylindrical portion; and said float supports a marine structure; and said float is engaged with a hollow form suspended from said float under water beneath said float; and said hollow form having an open top and an open bottom and a sealable lid movably engaged with said hollow form open top; wherein said flotation lid seals over said hollow form open top when a tipping force on said marine structure causes said float to be lifted out of the water, thus providing ballast and intact stability.

4. The float of claim 3 further comprising:

a floatation device fixedly engaged with said sealable lid; wherein said floatation device holds said sealable lid open when the float is under the water and allows said sealable lid to close when raised above the water, providing passive control of the sealable lid.

5. The float of claim 3 further comprising:

an actuator engaged with said sealable lid in communication with a controller that powers said actuator to close said sealable lid when said float rises above the water;

providing active control of said sealable lid.

6. The float of claim 5 further comprising:

position sensors in communication with said controller signal the controller that the hollow form has exited the water thus signaling the controller to power the actuator to close the sealable lid.

7. The float of claim 3 wherein:

said marine structure is a wind turbine.

* * * * *